US007923931B2

(12) United States Patent
Park et al.

(10) Patent No.: US 7,923,931 B2
(45) Date of Patent: Apr. 12, 2011

(54) PLASMA DISPLAY PANEL AND RELATED TECHNOLOGIES INCLUDING METHOD FOR MANUFACTURING THE SAME

(75) Inventors: Deok Hai Park, Daegu (KR); Min Soo Park, Seoul (KR); Young Sung Kim, Yongin-si (KR); Bo Hyun Kim, Suwon-si (KR)

(73) Assignee: LG Electronics Inc., Seoul (KR)

( * ) Notice: Subject to any disclaimer, the term of this patent is extended or adjusted under 35 U.S.C. 154(b) by 457 days.

(21) Appl. No.: 12/040,949

(22) Filed: Mar. 3, 2008

(65) Prior Publication Data

US 2008/0211409 A1 Sep. 4, 2008

(30) Foreign Application Priority Data

Mar. 2, 2007 (KR) ..... 10-2007-0020907
Mar. 6, 2007 (KR) ..... 10-2007-0021737

(51) Int. Cl.
*H01J 17/49* (2006.01)

(52) U.S. Cl. ..... 313/586; 313/587

(58) Field of Classification Search ..... 313/586, 313/587

See application file for complete search history.

(56) References Cited

U.S. PATENT DOCUMENTS

2007/0024530 A1* 2/2007 Jung et al. ..... 345/60
2007/0114669 A1* 5/2007 Park et al. ..... 257/758
2007/0126361 A1* 6/2007 Lee ..... 313/586
2007/0152593 A1* 7/2007 Kim et al. ..... 313/587
2007/0170950 A1* 7/2007 Lee ..... 324/770
2008/0157672 A1* 7/2008 Tsujita et al. ..... 313/586
2008/0157673 A1* 7/2008 Fukui et al. ..... 313/587
2008/0278074 A1* 11/2008 Yamamoto et al. ..... 313/582

FOREIGN PATENT DOCUMENTS

EP 1780749 A2 * 5/2007
EP 1796124 A2 * 6/2007
EP 1806762 A2 * 7/2007
JP 2004-103273 A 4/2004
JP 2005-330574 A 12/2005
WO WO 2005098889 A1 * 10/2005

OTHER PUBLICATIONS

Japanese Office Action dated Nov. 24, 2010 for Application No. 2008-051502, with English translation, 7 pages.

* cited by examiner

*Primary Examiner* — Nimeshkumar D Patel
*Assistant Examiner* — Glenn Zimmerman
(74) *Attorney, Agent, or Firm* — Fish & Richardson P.C.

(57) ABSTRACT

A plasma display panel is disclosed. The plasma display panel includes a first panel including address electrodes, a first dielectric layer, and a phosphor layer formed on a first substrate, and a second panel bonded with the first panel by interposing barrier ribs therebetween, the second panel including a plurality of transparent electrodes and bus electrodes, a second dielectric layer, a first protective layer containing magnesium oxide doped with a crystalline oxide, and a second protective layer containing crystalline magnesium oxide.

10 Claims, 13 Drawing Sheets

PLASMA DISPLAY PANEL AND RELATED TECHNOLOGIES INCLUDING METHOD FOR MANUFACTURING THE SAME

This application claims the benefit of the Korean Patent Applications No. P 10-2007-0020907, filed on, Mar. 2, 2007 and No. P 10-2007-0021737, filed on Mar. 6, 2007, which is hereby incorporated by reference as if fully set forth herein.

BACKGROUND

1. Field

The present disclosure relates to a plasma display panel and related technologies including a method for forming the same. Implementations include a plasma display having a protective layer and a method for forming the plasma display and/or its protective layer.

2. Discussion of the Related Art

With the advent of a multimedia age, there is a rising demand for the appearance of a more delicate and larger display device capable of representing colors closer to natural colors. Since a current cathode ray tube (CRT) presently has limited application to large screen displays (e.g., 40 inches or more), a liquid crystal display (LCD), a plasma display panel (PDP), a projection television (TV), etc. are rapidly growing for expansion of use ranges thereof up to high-definition imaging fields.

The most outstanding characteristics of the above-mentioned display devices including the plasma display panel are that the display devices can be manufactured with a thinner thickness than the self-luminous CRT, achieve easy manufacture of a flat large-scale screen (for example, 60~80 inches), and be clearly distinguished from the conventional CRT in a viewpoint of style or design.

The plasma display panel includes a lower panel having address electrodes, an upper panel having sustain electrode pairs, and discharge cells defined by barrier ribs. A phosphor is coated in each of the discharge cells, to display an image. More specifically, if a discharge occurs in a discharge space between the upper panel and the lower panel, ultraviolet rays generated by the discharge are incident to the phosphor to produce visible rays. With the visible rays, an image can be displayed.

Here, both the upper panel and lower panel of the plasma display panel are formed with dielectric layers, respectively, to protect the sustain electrode pairs and address electrodes. However, the upper dielectric layer formed on the upper panel may be worn and diminished due to a positive (+) ion shock caused upon a discharge of the plasma display panel. In this case, there is also a risk that a metal material, such as sodium (Na), etc. may cause a short of the electrodes. For this reason, magnesium oxide (MgO), having a high resistance against the positive (+) ion shock, has been conventionally coated over the upper dielectric layer formed on the upper panel.

However, the protective layer of the above-described plasma display panel has several problems as follows.

Firstly, when plasma in the plasma display panel is produced as a discharge gas upon receiving a voltage applied to the electrodes, ions contained in the plasma are introduced into the protective layer, thereby causing secondary electrons to be discharged from a surface of the protective layer. The discharge of secondary electrons consequently helps a gas discharge occur at a lower voltage. That is, the protective layer can efficiently endure the positive (+) ion shock, and has the effect of slightly lowering a firing voltage. As a result, the provision of the protective layer allows the panel to be driven at a low voltage. In turn, the low-voltage driving of the panel provides many advantages of reducing power consumption and consequently, production costs of the panel while achieving an improvement in brightness and discharge efficiency, etc.

However, MgO currently used as a material of the protective layer has a deficiency to efficiently lower a discharge voltage. This deficiency is due to material characteristics of MgO, and more particularly, is due to an extremely low discharge coefficient of secondary electrons in relation to ions introduced into the protective layer during production of plasma. More specifically, MgO has a strong covalent bond structure, and therefore, has a possibility of being easily bonded with foreign substances such as moisture, carbon monoxide, etc. Therefore, the protective layer may attain fine cracks at a surface thereof by a plasma particle shock, thereby suffering from a shortened lifespan and poor discharge efficiency of secondary electrons therefrom during an opposed discharge.

Secondly, when forming the protective layer using MgO, there is a problem of deterioration in jitter characteristics. As a result, the resulting plasma display panel has a deficiency of time to be assigned in a sustain period within one time frame during driving of the plasma display panel.

For example, when it is assumed that there exist 480 scan lines, and each line requires a scan time of 3 μs, and also, assumed that a single scan method for sequentially scanning from the first scan line to the last scan line is adopted, an address period, required in a single time frame divided into eight sub-fields, is more than 480×3 μs×8=13 ms.

Correspondingly, a time to be assigned in a sustain period within one time frame shall be shortened. A solution to assign a time more than such a deficient sustain period is to shorten a scan period. However, it is difficult to shorten the scan period because a scan pulse width must be lengthened in consideration of a jitter value during an address discharge. The jitter value is a discharge delay time caused upon an address discharge. The jitter value has some differences for each sub field, but belongs to a constant range during driving. Since the scan pulse includes such a jitter value, the scan pulse width inevitably becomes lengthened. As a result, the greater the jitter value, the longer the address period, and there exists a possibility of deterioration in picture quality.

A factor having the greatest effect on the jitter value during the address period is a discharge efficiency of secondary electrons from the protective layer. That is, the greater the discharge efficiency of secondary electrons from the protective layer, the smaller the jitter value. Since the scan pulse width is shortened as much as a reduced amount of the jitter value, consequently, the address period is shortened.

SUMMARY

Accordingly, the present disclosure is directed to a plasma display method and related technologies including a method for manufacturing the same.

In one implementation, a plasma display panel has an improved discharge efficiency of secondary electrons.

In another implementation a plasma display panel and a method for manufacturing the same, a discharge efficiency of secondary electrons can be improved, thereby lowering a firing voltage and power consumption of the plasma display panel while achieving high brightness and discharge efficiency.

In yet another implementation a plasma display panel has improved jitter characteristics.

Additionally, as embodied and broadly described herein, a plasma display panel comprises: a first panel including address electrodes, a first dielectric layer, and a phosphor layer formed on a first substrate; and a second panel bonded with the first panel by interposing barrier ribs therebetween, the second panel including a plurality of transparent electrodes and bus electrodes, a second dielectric layer, a first protective layer containing magnesium oxide doped with a crystalline oxide, and a second protective layer containing crystalline magnesium oxide.

In accordance with another aspect, there is provided a method for manufacturing a plasma display panel comprising: forming address electrodes, a first dielectric layer, and barrier ribs on a first substrate; coating phosphor layers in respective cells defined by the barrier ribs; sequentially forming a plurality of transparent electrodes and bus electrodes, and a second dielectric layer on a second substrate; forming a first protective layer containing magnesium oxide doped with a crystalline oxide on the second dielectric layer; forming a second protective layer containing crystalline magnesium oxide on the first protective layer; and bonding the first substrate and second substrate with each other.

It is to be understood that both the foregoing general description and the following detailed description are exemplary and explanatory and are intended to provide further explanation.

BRIEF DESCRIPTION OF THE DRAWINGS

The accompanying drawings, which are included to provide a further understanding are incorporated in and constitute a part of this disclosure, illustrate implementation(s) and together with the description serve to explain various principles. In the drawings.

DETAILED DESCRIPTION

Figure 1:
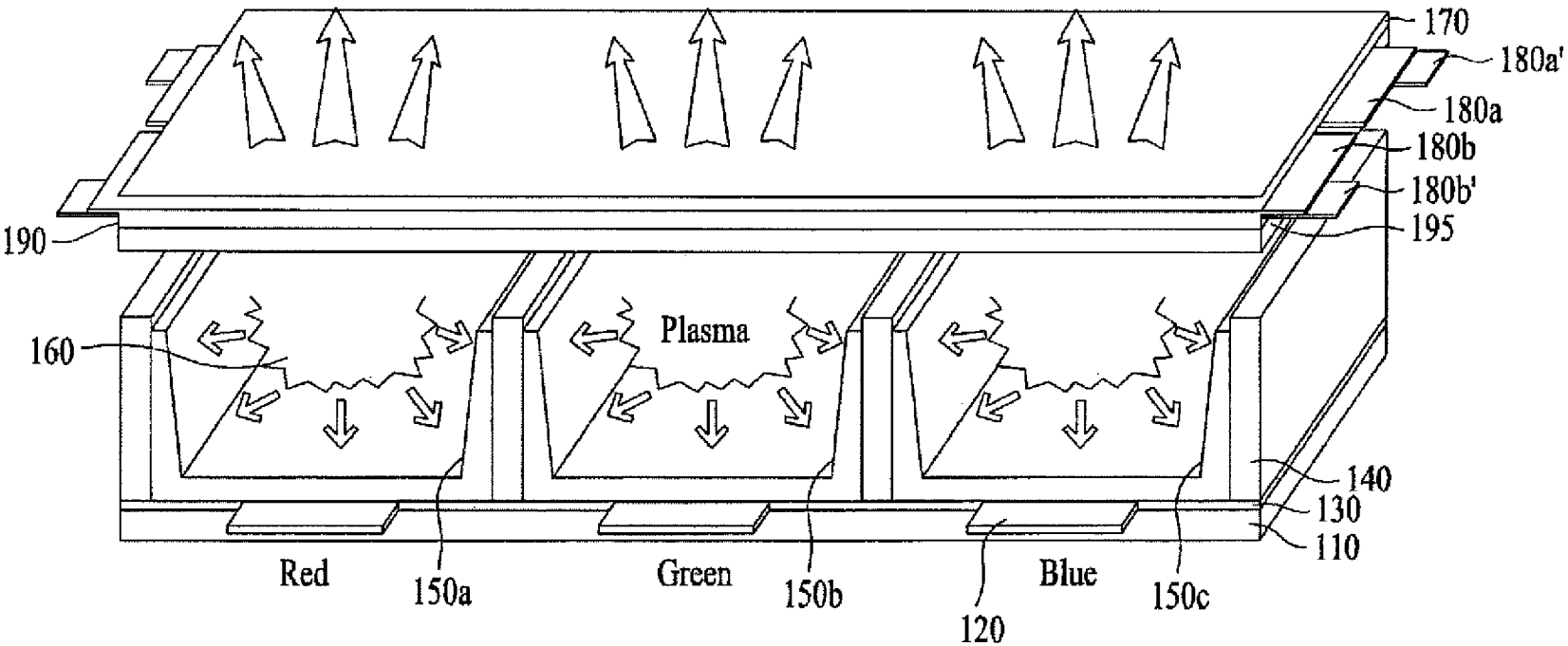
FIG. 1 is a view illustrating a discharge cell structure of a plasma display panel.

These and/or other aspects and advantages of the exemplary implementations will become apparent and more readily appreciated from the following description of the implementations.

Hereinafter, reference will now be made in detail to the various implementations, examples of which are illustrated in the accompanying drawings. Wherever possible, the same reference numbers will be used throughout the drawings to refer to the same or like parts.

In the drawings, dimensions of layers and regions are exaggerated for clarity of description, and a thickness ratio between neighboring layers shown in the drawings is not intended to represent an actual thickness ratio.

A plasma display panel has a feature that a protective layer has a double-layered structure. Hereinafter, one protective layer formed directly on an upper dielectric layer is referred to as a first protective layer, and the other protective layer formed on the first protective layer to face a discharge space is referred to as a second protective layer.

FIG. 1 is a view illustrating a discharge cell structure of a plasma display panel. Now, the discharge cell structure of a plasma display panel according to an implementation will be described with reference to FIG. 1.

As shown, the plasma display panel includes a front substrate 170, which is formed with transparent electrode pairs 180*a* and 180*b* extending in a direction and bus electrodes 180*a*' and 180*b*' formed of a conventional metal material. An upper dielectric layer 190 and a protective layer 195 are sequentially formed on the front substrate 170, to cover the transparent electrode pairs 180*a* and 180*b* and bus electrodes 180*a*' and 180*b*'.

The front substrate 170 is formed, for example, by milling and cleaning a glass for a display substrate. Here, the transparent electrode pairs 180*a* and 180*b* are formed, for example, by a sputtering and photo-etching method or a chemical vapor deposition (CVD) and lift-off method using indium tin oxide (ITO) or $SnO_2$. The bus electrodes 180*a*' and 180*b*' are formed of, for example, silver (Ag). Additionally, a black matrix can be formed between the transparent electrode pairs and the bus electrodes. The black matrix contains a low-melting-point glass, black pigment, etc.

The upper dielectric layer 190 is formed on the front substrate 170, which was formed with the transparent electrode pairs 180*a* and 180*b* and bus electrodes 180*a*' and 180*b*'. Here, the dielectric layer 190 consists of a transparent low-melting-point glass and a filler.

Then, the protective layer 195 is formed on the upper dielectric layer 190. The protective layer 195, as described above, is divided into double layers. Hereinafter, such a protective layer structure will be described with reference to FIGS. 2 and 3.

Figure 2:
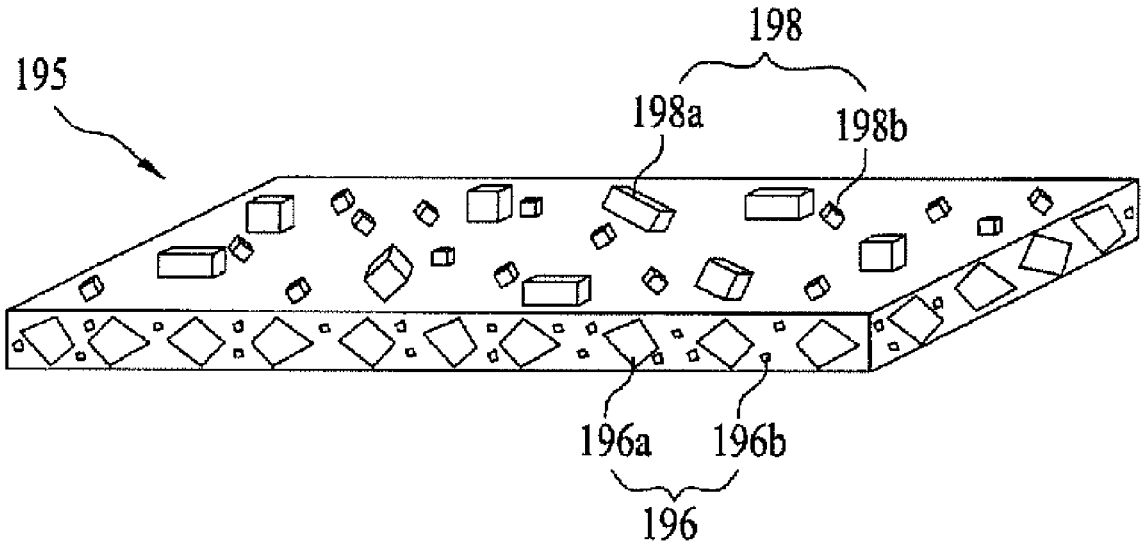
FIG. 2 is a perspective view illustrating an implementation of a protective layer of the plasma display panel.

FIG. 2 is a perspective view illustrating an implementation of the protective layer structure of the plasma display panel. As shown, the protective layer 195 is divided into a first protective layer 196 and a second protective layer 198. Here, the first protective layer 196 has a feature that magnesium oxide 196*a* is doped with a crystalline oxide 196*b*. The magnesium oxide 196*a* serves to protect the upper dielectric layer from a positive (+) ion shock caused upon a discharge. The crystalline oxide 196*b* serves to increase a discharge efficiency of secondary electrons, and is sufficient to occupy 0~10 wt % of the first protective layer.

The crystalline oxide 196*b* is formed of a material having a great secondary electron discharge coefficient, such as at least one of $SiO_2$, $TiO_2$, $Y_2O_3$, $ZrO_2$, $Ta_2O_5$, ZnO, $La_2O_3$, $CeO_2$, $Eu_2O_3$ and $Gd_2O_3$, or other transition metal oxides. Alternatively, the crystalline oxide 196*b* may be an alkali metal oxide in the form of $M_2O$, or an alkaline earth metal oxide in the form of M'O. Here, the alkali metal oxide may be at least one of $LiO_2$, $Na_2O$, $K_2O$, $Rb_2O$ and CsO, and the alkaline earth metal oxide may be at least one of BeO, CaO, SrO and BaO.

Figure 3:
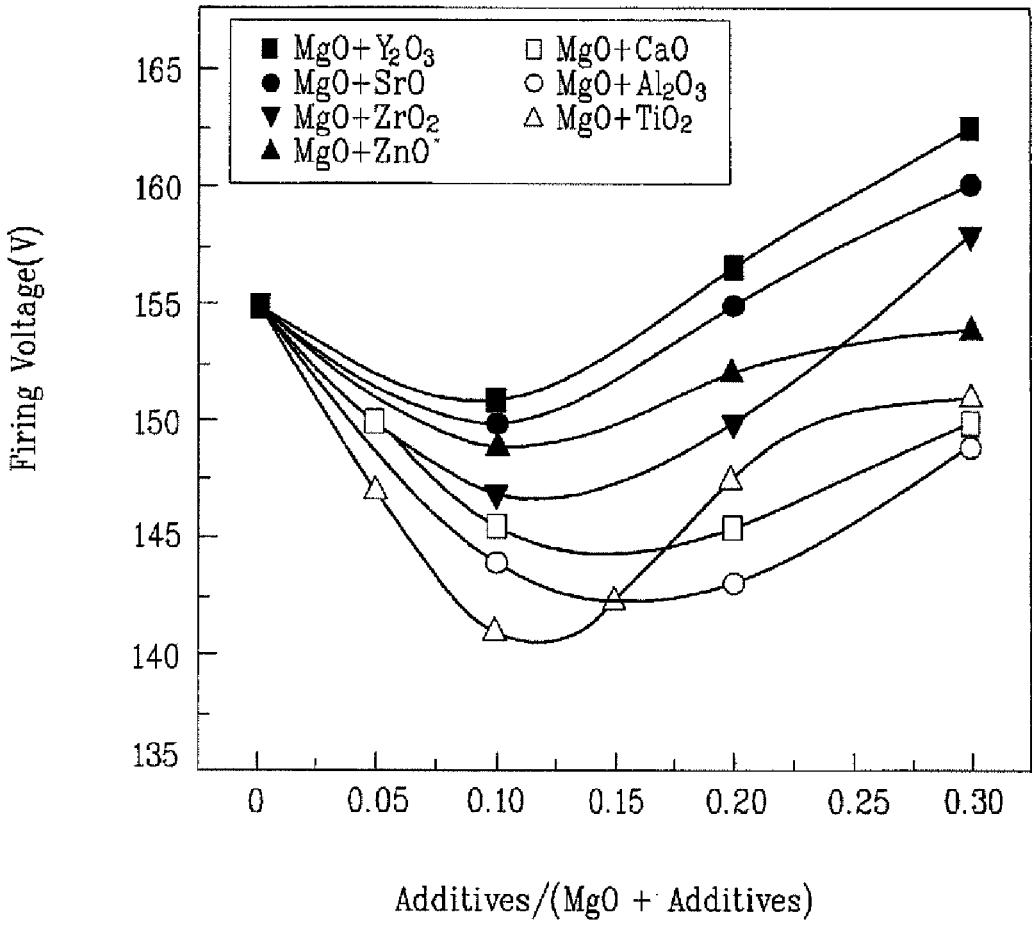
FIG. 3 is a graph illustrating firing voltages measured after mixing magnesium oxide with various oxides.

FIG. 3 is a graph illustrating firing voltages measured after mixing magnesium oxide with various oxides. Now, the crystalline oxide, which is used as a material of the protective layer of the plasma display panel, will be described with reference to FIG. 3.

When mixing magnesium oxide with various kinds of oxides, there is an effect of lowering a discharge voltage. FIG. 3 is a graph illustrating the variation of a firing voltage according to the amount of each additive oxide such as $Y_2O_3$, SrO, $ZrO_2$, ZnO, CaO, $Al_2O_3$ or $TiO_2$. In FIG. 3, it can be appreciated that a firing voltage can be lowered to the minimal value when a mole number of the additive is about 10% of the total mole number of the protective layer, although it may differ according to the kind of additive.

On the basis of the above-described result, a crystalline oxide may be doped on a conventional protective layer, and of course, any other kinds of oxides other than the above-mentioned oxides can be doped.

In the case where a dopant is added into the first protective layer 196, a jitter value during an address period decreases. However, the jitter value may increase when the content of the dopant exceeds more than a predetermined value. Therefore, the dopant may be doped only to within a range of assuring the minimal jitter value, and, the optimum content of the dopant is 20~500 ppm in the first protective layer 196. Alternatively, to decrease the jitter value, any other materials except for silicon may be used as the dopant. Here, the first protective layer 196 has a thickness of 300~700 nm. If the thickness of the first protective layer 196 is less than 300 nm, there is a possibility of discharge error. Also, if the thickness of the first protective layer 196 is more than 700 nm, it may cause problems in manufacturing processes and costs.

The second protective layer 198 is formed on the first protective layer 196. The second protective layer 198 has a feature that magnesium oxide 198*a* has a crystalline structure. In the following description, the term "size" denotes a diameter when crystals have a spherical shape, or a length of one side when crystals have a cube shape. Similarly, if a thickness of the second protective layer 198 is smaller than the above-mentioned allowable numerical value, there is a possibility of discharge error. Also, if the thickness is larger than the above-mentioned allowable numerical value, it may cause problems in manufacturing processes and costs.

The second protective layer 198 may be formed on only a part of a surface of the first protective layer 195, rather than being formed on the overall surface of the first protective layer 196. As shown, the second protective layer 198 may be formed irregularly, and also, may be formed over only a partial area of 30~80% of the overall surface of the first protective layer 196. Here, the second protective layer 198 consequently has an uneven structure, thereby being capable of increasing a surface area of the protective layer, and resulting in an increased discharge efficiency of secondary electrons.

In the present implementation, the magnesium oxide 198*a* may have a mono-crystalline structure, and has a feature in that a cathode luminescence thereof has a maximal value in a wavelength band of 300~500 nm. Accordingly, mono-crystalline magnesium oxide powder can be formed, to have the form of clusters, on a part of the first protective layer 196, thereby providing the protective layer with an uneven overall surface structure. With this uneven surface structure, ultraviolet ions generated during a gas discharge of the plasma display panel collide with the protective layer over an increased surface area. This has the effect of increasing a discharge amount of secondary electrons and lowering a firing voltage, and consequently, achieving an improved discharge efficiency and jitter characteristics.

The crystalline magnesium oxide 198*a* in the second protective layer 198 can be doped with a dopant 198*b*. The second protective layer 198 can be formed using a chemical vapor deposition method, E-beam method, sol-gel method, ion plating method, sputtering method, or the like. The crystalline magnesium oxide 198*a* in the second protective layer 198 can be formed to have a size of 50~1,000 μm, and have a mono-crystalline structure when being formed using a chemical vapor deposition method. Here, the "size" of the crystalline magnesium oxide may denote a diameter of spherical crystals, or a length of one side of cubic crystals. The mono-crystalline structure denotes a solid in which all crystals are regularly arranged along a predetermined crystalline axis, and is distinguished from a poly-crystalline structure consisting of groups of small mono-crystals having different orientations from one another.

The dopant 198*b* included in the second protective layer 198 is selected from the group consisting of aluminum (Al), chrome (Cr), hydrogen ($H_2$), silicon (Si), scandium (Sc) and gadolinium (Gd). In one instance, the dopant 198*b* has a content of 300~1,000 ppm. The reason of delimiting the content of the dopant 198*b* is the same as the reason of delimiting the content of the dopant in the first protective layer 196.

The second protective layer 198 may have a thickness of 100~300 nm. If the thickness of the second protective layer 198 is less than 100 nm, it is difficult to achieve a desired crystalline magnesium oxide structure. Also, if the thickness of the second protective layer 196 is more than 300 nm, it may cause problems in manufacturing processes and costs.

With the above-described first protective layer 196 that is formed of magnesium oxide doped, for example, with a silicon oxide, even if positive (+) ions are generated while a discharge occurs in a discharge space, the upper dielectric layer 190 can be protected from a positive (+) ion shock. Also, the second protective layer 198, which is formed of magnesium oxide doped with a desired dopant, can act to greatly reduce a discharge delay time, and result in improved jitter characteristics. It could be appreciated from a test performed on the plasma display panel according to the present implementation that the use of the above-described protective layers has the effect of reducing a discharge delay time to 1 μs or less. Also, it could be appreciated that the first protective layer 196 containing a silicon oxide can contribute to improve the discharge efficiency of secondary electrons from the overall protective layer.

Meanwhile, the plasma display panel further includes a back substrate 110, which is formed at a front surface thereof with address electrodes 120 extending in a direction orthogonal to the transparent electrode pairs 180*a* and 180*b*. A white dielectric layer 130 is formed on the front surface of the back substrate 110, to cover the address electrodes 120. The white dielectric layer 130 is formed by coating a dielectric material using a printing or film laminating method, and baking the coated dielectric material. Then, barrier ribs 140 are formed on the white dielectric layer 130 such that they are arranged between the respective neighboring address electrodes 120. The barrier ribs 140 may be of a stripe-type, well-type, or delta-type.

Although not shown, a black top can be formed on the barrier ribs 140. Red, Green, and Blue phosphor layers 150*a*, 150*b*, and 150*c* are formed between the respective neighboring barrier ribs 140. Locations where the address electrodes 120 on the back substrate 110 intersect the sustain electrode pairs 180*a* and 180*b* on the front substrate 110 are regions defining discharge cells, respectively.

The front substrate 170 and the back substrate 110 are bonded to each other while interposing the barrier ribs 140 therebewteen by use of a sealing material provided along the outlines of both the substrates. Also, the front substrate 170 serving as an upper panel and the back substrate 110 serving as a lower panel are connected with a driving apparatus.

Figure 4:
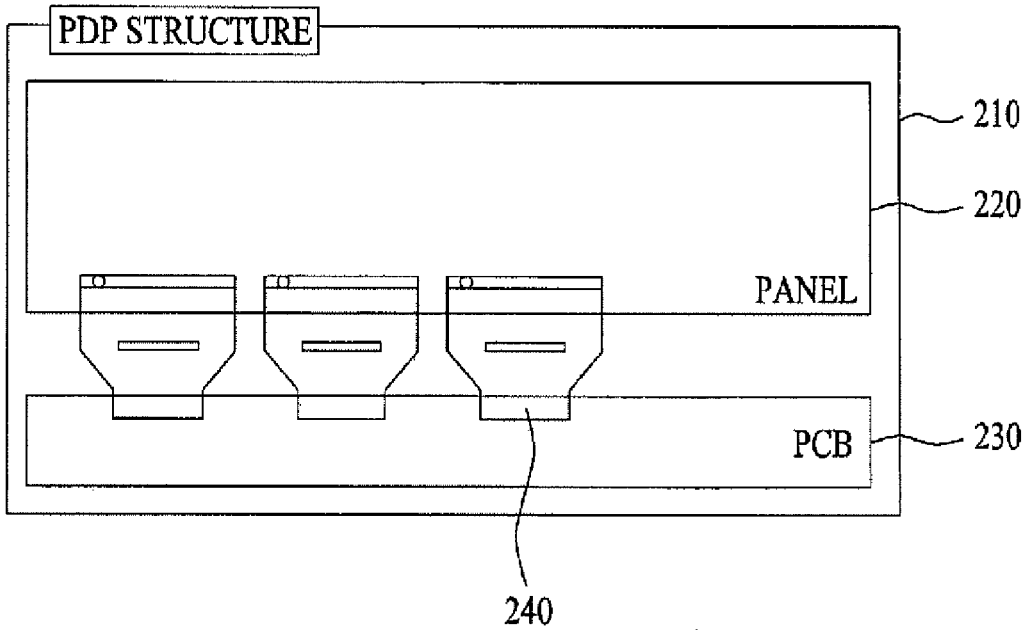
FIG. 4 is a view illustrating a driving apparatus and connector for the plasma display panel.

FIG. 4 is a view illustrating a driving apparatus and connector of the plasma display panel. Hereinafter, the plasma display panel having the above described configuration, driving apparatus, and connector will be described with reference to FIG. 4.

As shown, the overall plasma display device includes a panel 220, a driving substrate 230 to supply a driving voltage to the panel 220, and a tape carrier package 240 (hereinafter, referred to as a "TCP") as one kind of a soft substrate that connects electrodes in relation to respective cells of the panel 220 with the driving substrate 230. Here, the panel 220, as described above, includes the front substrate, back substrate, and barrier ribs.

Electrical and physical connections between the TCP 240 and the panel 220 and electrical and physical connections between the TCP 240 and the driving substrate 230 are obtained by use of an anisotropic conductive film (hereinafter, referred to as "ACF"). The ACF is a conductive resin film formed using nickel (Ni) balls each coated with gold (Au).

Figure 5:
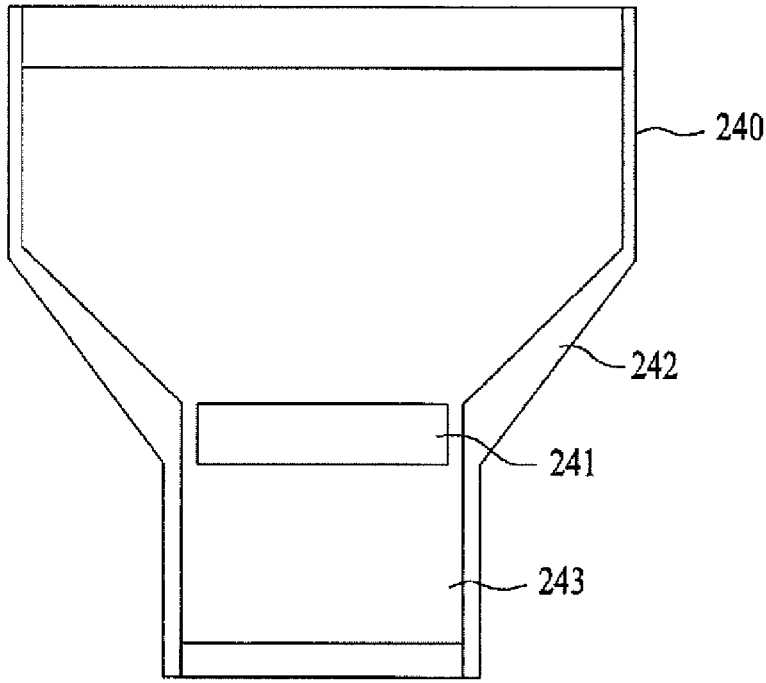
FIG. 5 is a view illustrating a substrate wiring structure of a general tape carrier package.

FIG. 5 is a view illustrating a general substrate wiring structure of the TCP.

As shown, the TCP 240 serves to connect the panel 220 and the driving substrate 230 with each other, and is equipped with a driver chip. The TCP 240 includes a wiring 243 densely arranged on a soft substrate 242, and a driver chip 241 connected with the wiring 243 and adapted to supply power transmitted from the driving substrate 230 to a specific electrode on the panel 220. Here, since the driver chip 241 is configured to alternately output many high-power signals upon receiving low voltages and driving control signals, it has a small number of wiring connected with the driving substrate 230 and a large number of wiring connected with the panel 220. As a result, the wiring connection of the driver chip 241 is accomplished through a space toward the driving substrate 230. Also, the wiring 243 may be unbounded about the center of the driver chip 241.

Figure 6:
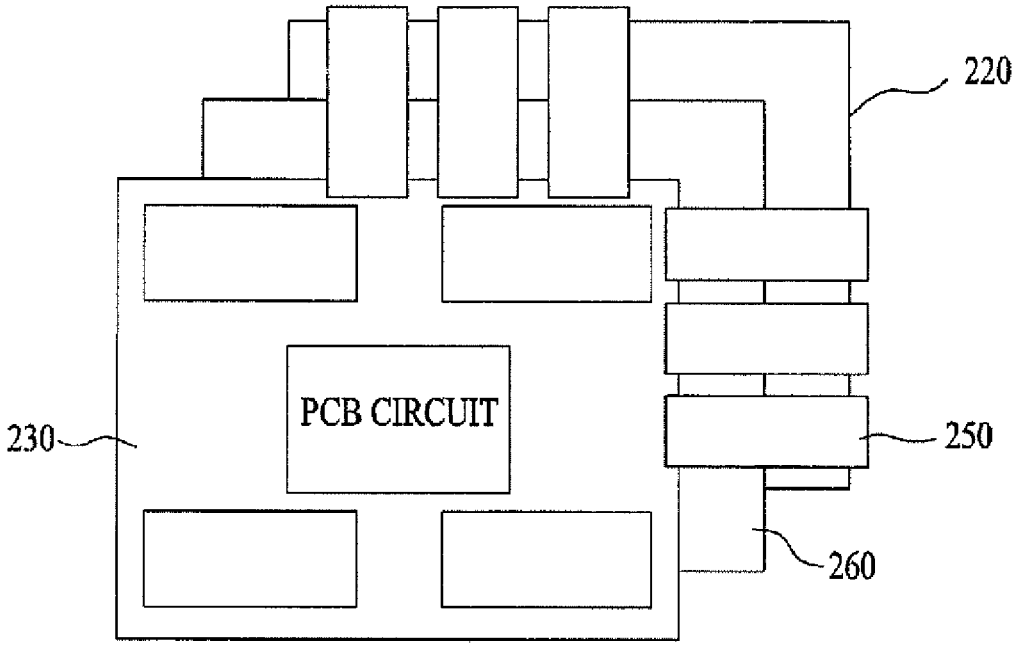
FIG. 6 is a view diagrammatically illustrating a plasma display panel according to another implementation.

FIG. 6 is a view diagrammatically illustrating a plasma display panel according to another implementation.

In the present implementation, the panel 220 is connected with the driving apparatus through a flexible printed circuit 250 (hereinafter, referred to as a "FPC"). Here, the FPC 250 is a film having an interior pattern formed using polyimide. Similarly, in the present implementation, the FPC 250 and the panel 220 are connected with each other by the ACF. Of course, in the present implementation, the driving substrate 230 is a PCB circuit.

The driving apparatus includes, for example, a data driver, a scan driver, and a sustain driver. The data driver is connected with address electrodes, to apply a data pulse. The scan driver is connected with scan electrodes, to supply a Ramp-up waveform, Ramp-down waveform, scan pulse, and sustain pulse. The sustain driver applies a sustain pulse and DC voltage to common sustain electrodes.

The plasma display panel is driven for a time frame that is divided into a reset period, an address period, and a sustain period. During the reset period, a Ramp-up waveform is applied to all scan electrodes simultaneously. During the address period, a negative polarity scan pulse is sequentially applied to the scan electrodes. Simultaneously with the sequential application, a positive polarity data pulse is synchronized with the scan pulse, to thereby be applied to the address electrodes. Also, during the sustain period, a sustain pulse is applied alternately to the scan electrodes and the sustain electrodes.

FIGS. 7A to 7L are views illustrating an implementation of a method for manufacturing the plasma display panel. Now, a method for manufacturing the plasma display panel will be described with reference to FIGS. 7A to 7L.

Figure 7A:
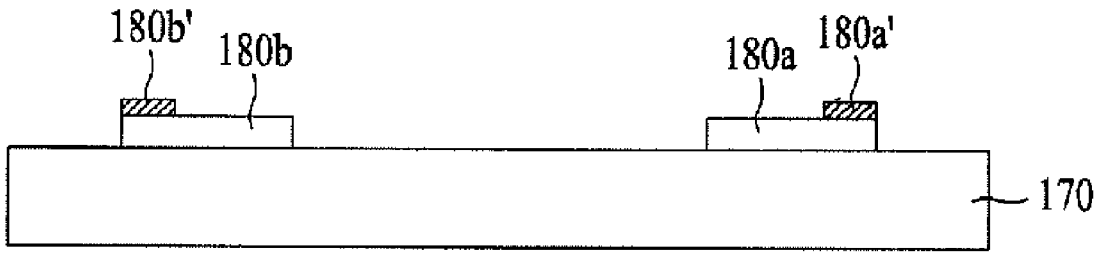
FIGS. 7A to 7L are views illustrating a method for manufacturing a plasma display panel.

First, as shown in FIG. 7A, the transparent electrode pairs 180*a* and 180*b* and bus electrodes 180*a*' and 180*b*' are formed on the front substrate 170. Here, the front substrate 170 is formed by milling and cleaning a glass for a display substrate or sodalime glass.

The transparent electrode pairs 180*a* and 180*b* are formed, for example, by a sputtering and photo-etching method or a chemical vapor deposition (CVD) and lift-off method using indium tin oxide (ITO) or $SnO^2$. The bus electrodes 180*a*' and 180*b*' are formed, for example, by a screen printing method or photosensitive paste method using silver (Ag). A black matrix can be formed on the transparent electrode pairs 180*a* and 180*b*, for example, by a screen printing method or photosensitive paste method using a low-melting-point glass, black pigment, etc.

Figure 7B:
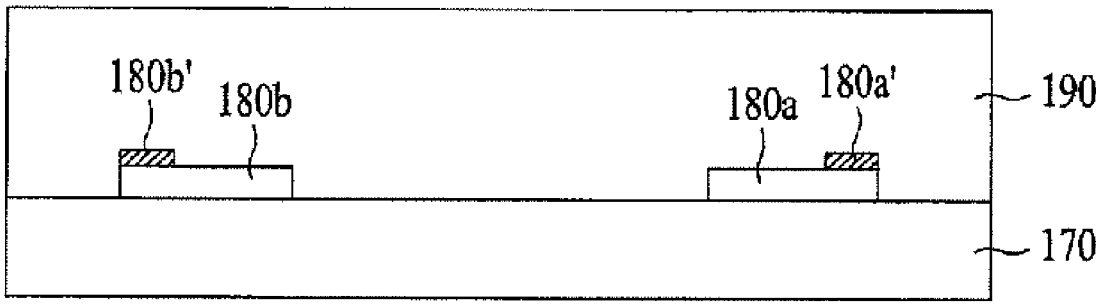

After completely forming he transparent electrode pairs 180*a* and 180*b* and bus electrodes 180*a*' and 180*b*', as shown in FIG. 7B, the upper dielectric layer 190 is formed on the front substrate 170 by stacking a material containing low-melting-point glass, etc. using a screen printing method, coating method, green sheet laminating method (in the case of an extended graphic array (XGA) display), or the like.

Figure 7C:
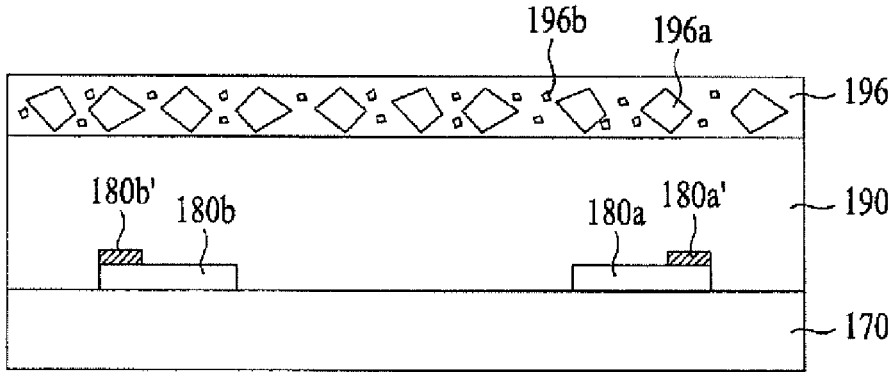

Then, as shown in FIG. 7C, the first protective layer 196 is formed on the upper dielectric layer 190. The formation of the first protective layer 196 has a feature that the magnesium oxide 196*a* is doped with the crystalline oxide 196*b*. More specifically, the first protective layer 196 is formed by preparing a material containing the magnesium oxide 196*a*doped with the crystalline oxide 196*b*, and depositing the prepared material on the upper dielectric layer 190. The crystalline oxide 196*b* is a material having a great secondary electron discharge coefficient, and may be any one of the above-described transition metal oxide, alkali metal oxide, and alkaline earth metal oxide. After drying the first protective layer 196, the first protective layer 196 is subjected to a baking process. The baking process can be performed simultaneously with the second protective layer 198. Also, the deposition of the constituent material of the first protective layer 196 can be performed using a chemical vapor deposition method, E-beam deposition method, sputtering method, ion plating method, or the like. Here, it is natural that the crystalline oxide must occupy 0-10 wt % of the above described material.

In the above described E-beam deposition method, if electron beams are irradiated to collide with a protective layer material, the protective layer material can be deposited on an upper dielectric layer by being vaporized and diffused, to thereby form a protective layer. In this case, by concentrating energy of the electron beams to a target surface, a high purity protective layer can be formed using a high speed deposition. Meanwhile, the ion plating method is a general term representing a combination of a vacuum deposition method and sputtering method. In the ion plating method, a protective layer can be formed on the basis of principles that plasma is produced by a glow discharge caused when a high voltage is applied under a highly depressurized vacuum environment, and a part of vaporized atoms is ionized.

Figure 7D:
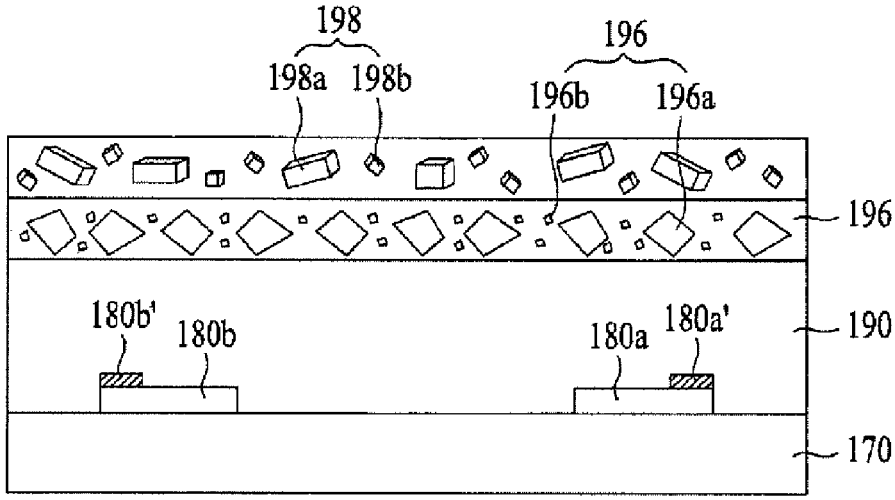

After the formation of the first protective layer 196, as shown in FIG. 7D, the second protective layer 198 is formed on the first protective layer 196. Here, the second protective layer 198 has a feature that it is formed of the mono-crystalline or poly-crystalline magnesium oxide 198*a*. More specifically, after preparing a material containing crystalline magnesium oxide, the prepared material is deposited on the first protective layer 196. In this case, the deposition can be performed using a spray coating method, bar coating method, blade coating method, spin coating method, ink-jet method, green sheet method, or the like.

The second protective layer 198, as described above, may be formed on a part of the first protective layer 196, or may be irregularly distributed on the first protective layer 196 rather than being regularly distributed. Also, in the course of milling the crystalline magnesium oxide, the size of the crystalline magnesium oxide can be adjusted to 50~1,000 nm, and the thickness of the second protective layer can be adjusted to 400~1,000 nm.

Now, an implementation of a process for forming the above described protective layer will be described in more detail. First, a first protective layer material is prepared. The first protective layer material has a feature that a slight amount of dopant is added to magnesium oxide. The first protective layer material may have the form of a single source material containing magnesium oxide doped with a dopant, or may have the form of a mixture of separately prepared materials.

Then, a first protective layer is formed using an E-beam method. More specifically, the above-described first protective layer material is heated at a high temperature such that the first protective layer is deposited on the upper dielectric layer by use of physical energy. Of course, the first protective layer can be formed using a chemical vapor deposition method, ion plating method, sol-gel method, sputtering method, or the like, other than the E-beam method. However, in consideration of mass productivity and superior properties of the protective layer, the E-beam method has particular utility. Here, it has been experimentally found that forming the first protective layer using only magnesium oxide takes an aging time of about 9 hours, but the aging time can be greatly reduced when forming the first protective layer using a silicon dopant.

After forming the first protective layer, a second protective layer material is prepared by doping magnesium oxide with at least one of Al, Cr, $H_2$, Si, Sc, and Gd.

Then, a second protective layer is formed using, for example, a chemical vapor deposition method. More specifically, the second protective layer is formed on the first protective layer using steam generated by heating the above-described second protective layer material. In this case, the mono-crystalline magnesium oxide is deposited together with the at least one dopant.

Here, the magnesium oxide having a mono-crystalline structure has a feature in that a cathode luminescence thereof has a maximal value in a wavelength band of 300~500 nm. In the present implementation, the mono-crystalline magnesium oxide having high discharge stability and superior temperature resistance property is used as a material of the second protective layer.

Also, the chemical vapor deposition method allows the magnesium oxide and dopant(s) in the second protective layer to have a medium physical property of a layer and crystals, and can reinforce a deposition strength of the second protective layer as compared to a spraying method, or the like.

Figure 7E:
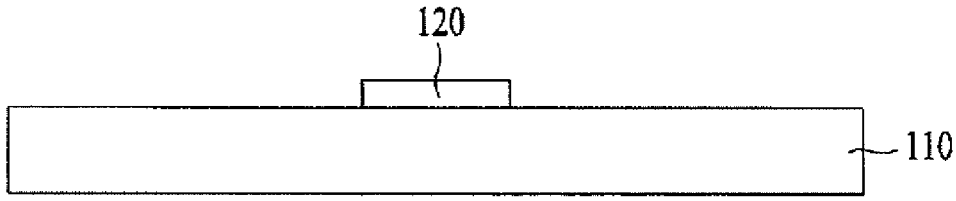

Thereafter, as shown in FIG. 7E, the back substrate 110 having the address electrode 120 is formed. First, the back substrate 110 is formed, for example, by milling and cleaning a glass for a display substrate or sodalime glass. Then, the address electrodes 120 are formed on the back substrate 110. The address electrodes 120 are formed by a screen printing method, photosensitive paste method, or sputtering/photoetching method using, for example, silver (Ag).

Figure 7F:
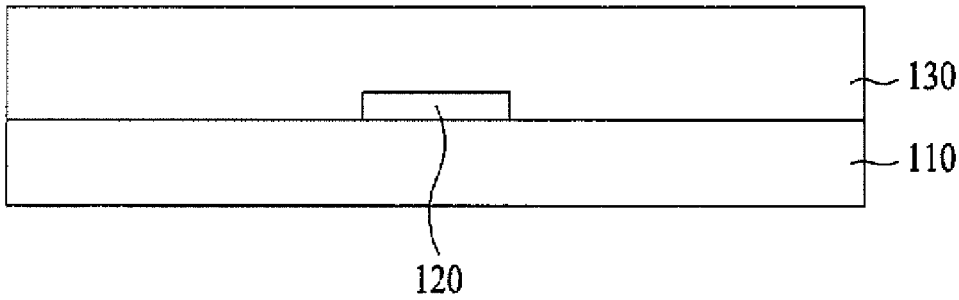
Figure 7G:
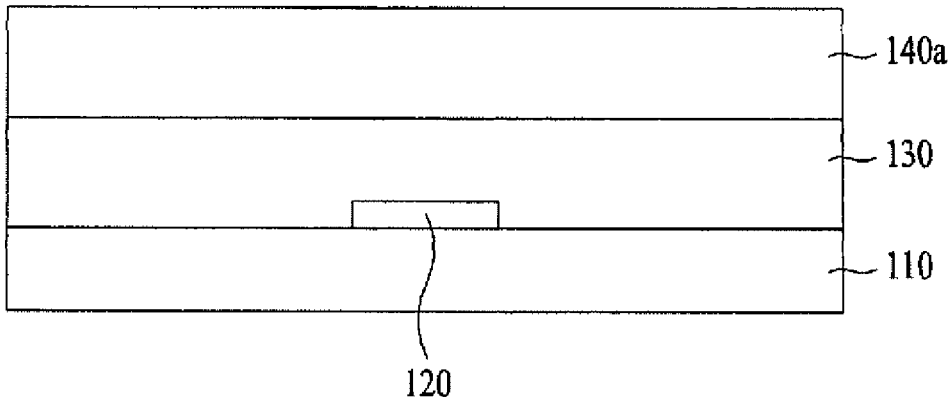
Figure 7H:
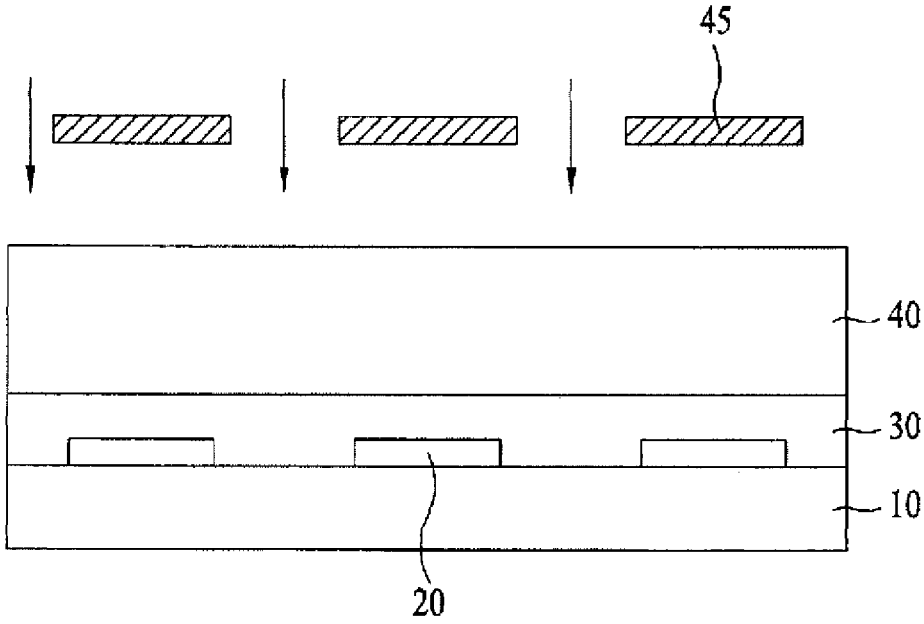
Figure 7I:
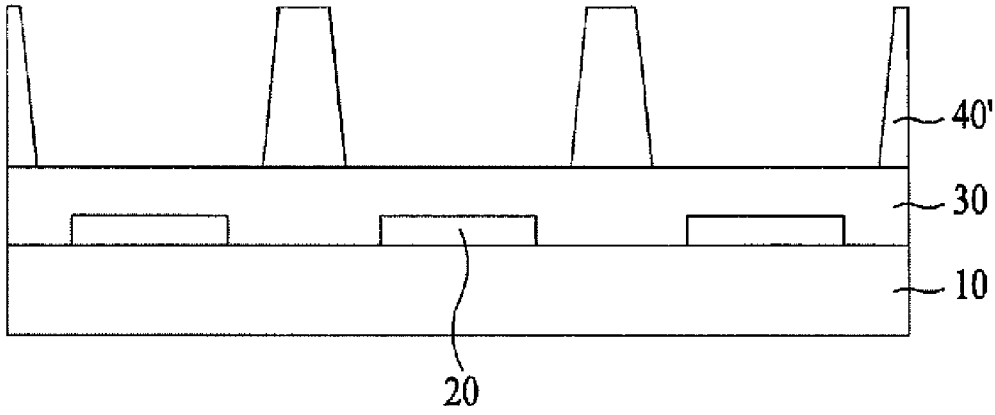
Figure 7J:
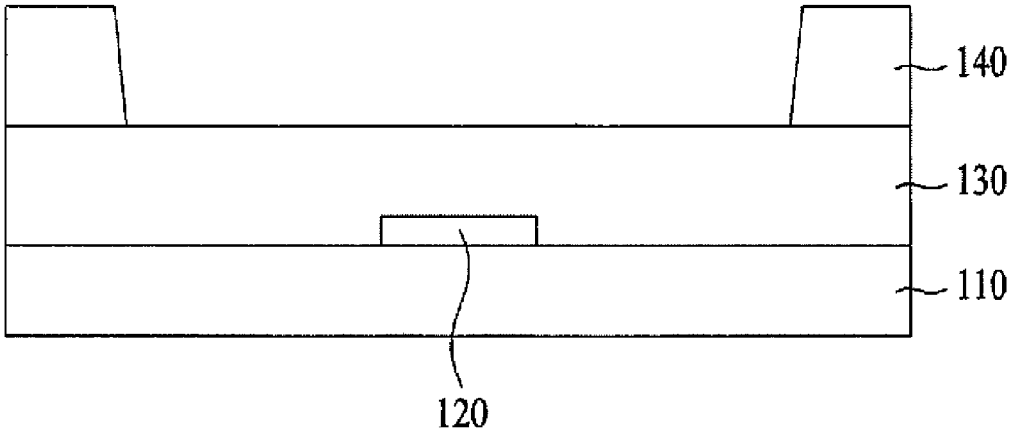

Then, as shown in FIG. 7F, the lower dielectric layer 130 is formed on the back substrate 110 to cover the address electrodes 120. The lower dielectric layer 130 is formed, for example, using a screen printing method or green sheet laminating method of a material containing a low-melting-point, a filler such as TiO2, etc. Here, the lower dielectric layer 130 has a white color suitable to increase the brightness of the plasma display panel.

Subsequently, as shown in FIGS. 7G to 7J, the barrier ribs 140 are formed to define discharge cells. In this case, a barrier rib material 140*a* consists of a parent glass and a filler. The parent glass may include PbO, $SiO_2$, $B_2O_3$, and $Al_2O_3$, and the filler may include $TiO_2$ and $Al_2O_3$.

The barrier rib material 140*a* is patterned, to form barrier ribs. The patterning is performed by externally exposing the barrier rib material 140*a* after covering a part of the barrier rib material 140*a* with a mask 145 and then, developing the exposed barrier rib material 140*a*. More specifically, if the barrier rib material 140*a* is externally exposed in a state wherein the mask 145 is positioned to cover the address electrodes 120, only locations of the barrier rib material 140*a*, where light is irradiated, remain after performing developing and baking processes, to form the barrier ribs 140. Here, when the barrier rib material 140*a* contains a photoresist component, the patterning of the barrier rib material 140*a* can be more easily performed.

Figure 7K:
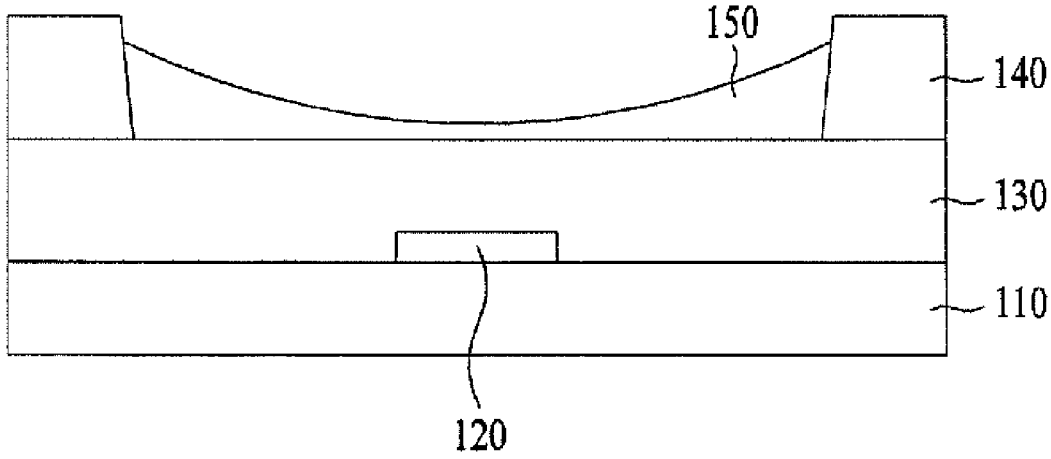

Then, as shown in FIG. 7K, phosphor layers 150*a*, 150*b*, and 150*c* are coated on a surface of the lower dielectric layer 130 facing the discharge space, and side surfaces of the barrier ribs. More specifically, Red, Green, and Blues phosphor layers are sequentially coated in respective corresponding discharge cells using a screen printing method or photosensitive paste method.

Figure 7L:
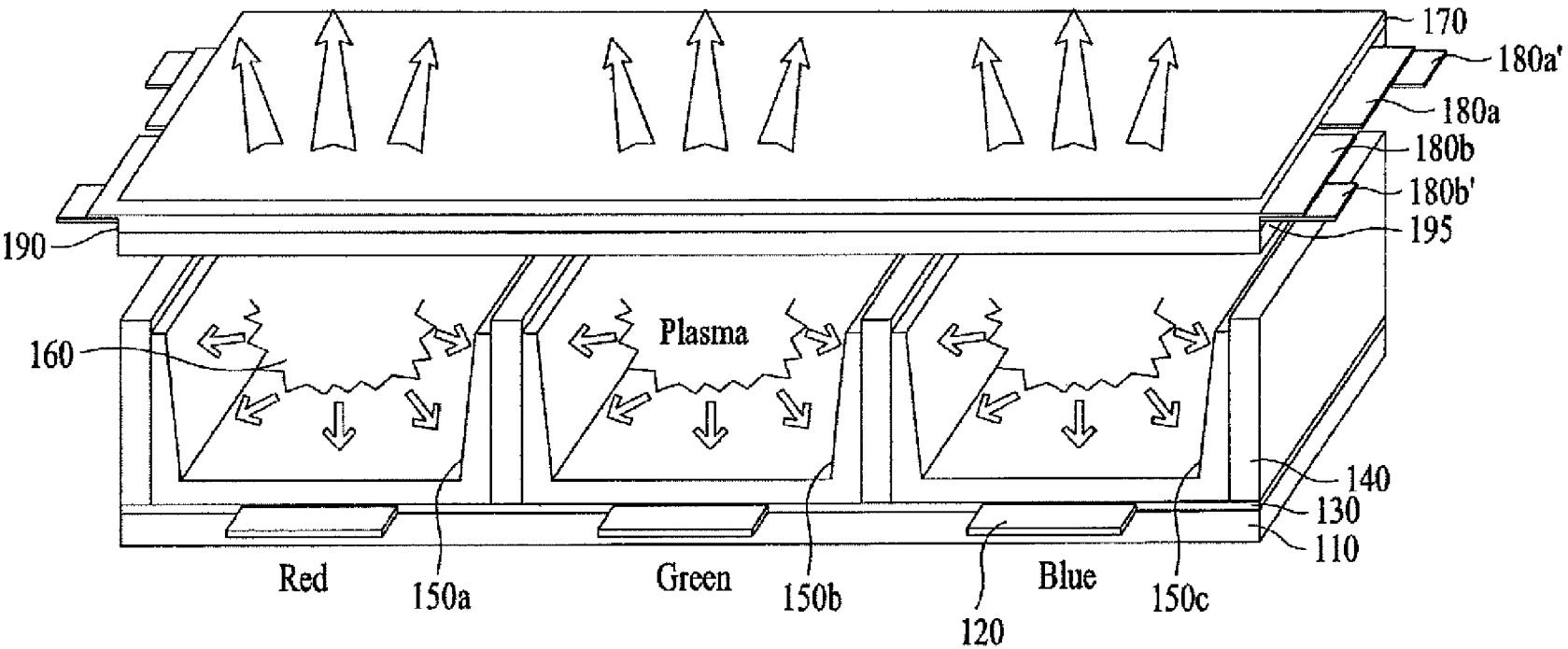
Figure 8A:
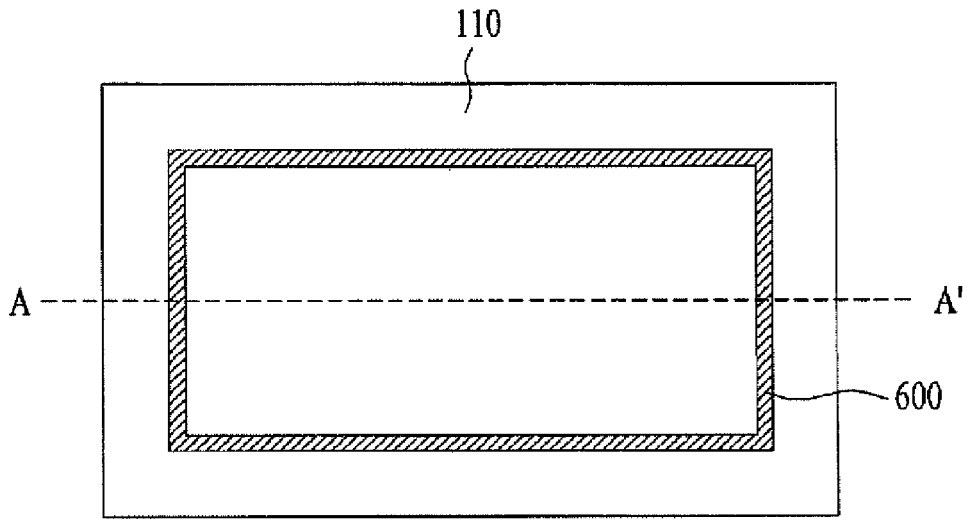
FIG. 8A is a view illustrating a process for bonding a front substrate and a back substrate of the plasma display panel with each other.
Figure 8B:
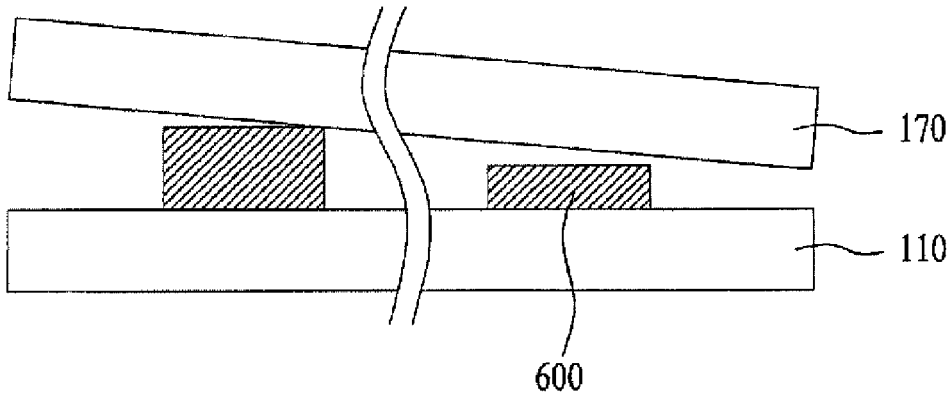
FIG. 8B is a sectional view taken along the line A-A' of FIG. 8A.

As shown in FIG. 7L, after bonding and sealing the front substrate as an upper panel and the back substrate as a lower panel such that the barrier ribs are interposed therebetween, a discharge gas 160 is injected after exhausting interior impurities, etc.

It will be apparent to those skilled in the art that various modifications and variations can be made.

What is claimed is:

1. A plasma display panel comprising: a first panel including address electrodes, a first dielectric layer, and a phosphor layer located on a first substrate; and a second panel including transparent electrodes and bus electrodes, a second dielectric layer, a first protective layer including magnesium oxide doped with a crystalline oxide, and a second protective layer including crystalline magnesium oxide; and barrier ribs located between the first and second panels, wherein the first protective layer contains up to 10 wt % of the crystalline oxide, wherein the second protective layer contains the dopant having a content of 300-1,000 ppm, and wherein the second protective layer is distributed on an area of only 30-80% of the first protective layer.

2. The plasma display panel according to claim 1, wherein the crystalline oxide is selected from the group consisting of $SiO_2$, $TiO_2$, $Y_2O_3$, $ZrO_2$, $Ta_2O_5$, ZnO, $La_2O_3$, $CeO_2$, $Eu_2O_3$ and $Gd_2O_3$.

3. The plasma display panel according to claim 1, wherein the crystalline oxide is an alkali metal oxide in the form of $M_2O$, where M is an alkali metal.

4. The plasma display panel according to claim 1, wherein the crystalline oxide is an alkaline earth metal oxide in the form of M'O, where M' is an alkaline earth metal.

5. The plasma display panel according to claim 1, wherein the crystalline magnesium oxide included in the second protective layer has a size of 50-1,000 nm.

6. The plasma display panel according to claim 1, wherein the crystalline magnesium oxide included in the second protective layer has a mono-crystalline structure.

7. The plasma display panel according to claim 1, wherein the crystalline magnesium oxide has a maximal cathode luminescence value in a wavelength band of 300-500 nm.

8. The plasma display panel according to claim 1, wherein the second protective layer further includes a dopant selected from the group consisting of Al, Cr, H2, Si, Sc, and Gd.

9. The plasma display panel according to claim 1, wherein the second protective layer is irregularly distributed on the area of only 30-80% of the first protective layer.

10. The plasma display panel according to claim 9, wherein the second protective layer is irregularly distributed on only a partial area within only 30-80% of the first protective layer.

* * * * *